US005394570A

United States Patent [19]

Tzang

[11] Patent Number: 5,394,570

[45] Date of Patent: Mar. 7, 1995

[54] TOILET SEAT RING AUTOMATIC RAISING APPARATUS AS ELECTROMAGNETICALLY ACTUATED

[76] Inventor: Tzong P. Tzang, No. 9-2, Lane 50, Sec. 2, Wu-Chang St., Taipei,

[21] Appl. No.: 179,646

[22] Filed: Jan. 7, 1994

Related U.S. Application Data

[62] Division of Ser. No. 110,895, Aug. 24, 1993.

[51] Int. Cl.[6] ..... A47K 13/10

[52] U.S. Cl. ..... 4/246.1; 4/237; 4/241

[58] Field of Search ..... 4/237, 241, 246.1, 246.3, 4/246.4, 246.5, 248; 220/263, 264

[56] References Cited

U.S. PATENT DOCUMENTS

| | | | |
|---|---|---|---|
| 2,888,290 | 5/1959 | Pierce | 292/251.5 |
| 3,184,803 | 5/1965 | Peel | 292/251.5 |
| 3,258,285 | 6/1966 | Smith | 292/251.5 |
| 4,426,743 | 1/1984 | Seabrooke | 4/246.3 |
| 4,561,130 | 12/1985 | Bumgardner et al. | 4/240 |
| 4,951,323 | 8/1990 | Shalom | 4/246.1 |
| 5,020,165 | 6/1991 | Huang | 4/246.2 |
| 5,150,483 | 9/1992 | Lochrie | 4/246.1 |

*Primary Examiner*—Henry J. Recla
*Assistant Examiner*—Charles R. Eloshway

[57] ABSTRACT

A toilet seat ring automatic raising structure includes a pair of actuating legs with appropriate weight for lifting up the seat ring automatically. The actuating legs have magnetic rods which are attracted to the iron cones in an electromagnetic device so that the seat ring can be securely held in place. The releasing of the magnetic force is used to lift up the seat ring automatically.

2 Claims, 6 Drawing Sheets

TOILET SEAT RING AUTOMATIC RAISING APPARATUS AS ELECTROMAGNETICALLY ACTUATED

CROSS-REFERENCE TO RELATED APPLICATION

This is a divisional application of application Ser. No. 08/110,895, filed on Aug. 24, 1993.

BACKGROUND OF THE INVENTION

Field of the Invention

The present invention relates to a toilet seat automatic raising structure using magnetic. More specifically, the present invention relates to a toilet seat ring raising structure which functions automatically either by use of a magnetic lever or a magnetic spring.

Description of the Prior Art

Heretofore, there are many types of toilet seat automatic raising structures developed. However, the majority of these structures are not widely accepted by the general public. Therefore, manufacturers do not want to produce them in high quantities. This is because these toilet seat raising structures are fairly complicated and the manufacturing costs are relatively high. These automatic raising structures are considered unnecessary because of their high price, therefore, they are not generally accepted by the public consumer.

In addition to the drawback in high cost, the complex structure which commonly requires mechanical components such as gears and linkages are not user friendly. A user has to push the button for the device to operate. However, the user that is not familiar with the device may manually lift up the toilet seat directly. This could destroy the structure of the automatic raising device and possibly damage the toilet seat. This is inconvenient for the user.

Despite the drawbacks, the toilet seat automatic raising structure is still practical to be used in our daily lives. The majority of the user do not lift up the toilet seat ring after use, this is partly a habitual thing and partly because the users do not want to touch the unsanitary seat ring. Therefore, it would be nice to have a toilet seat ring automatic lifting device installed with the toilet tank.

SUMMARY OF THE INVENTION

The main object according to the present invention is to provide a magnetic type toilet seat ring automatic raising device which is of simple construction and practical of use. Such automatic raising device can either use a magnetic spring.

Another object according to the present invention is to provide a toilet seat ring automatic raising device such that the manufacturing cost of the device is effectively lower.

A further object according to the present invention is to provide a toilet seat ring automatic raising device so that the user can be accustomed to the lifting of the toilet seat ring for the convenience of others.

Still another object according to the present invention is to provide a toilet seat ring automatic raising device such that the cover can also be lifted up manually without causing any damage to the structure.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 2:
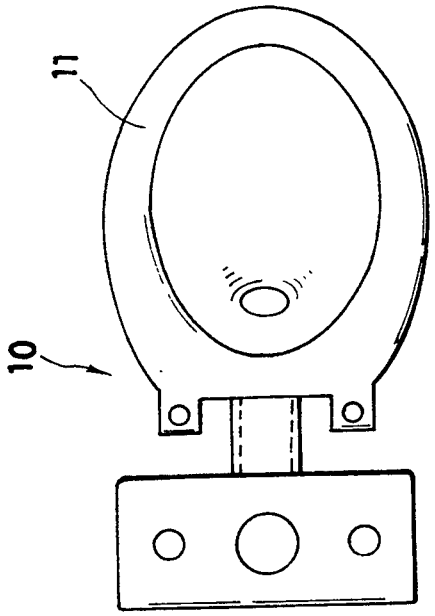
FIG. 2 is a top view of FIG. 1 before the installation of the actuating legs.
Figure 1:
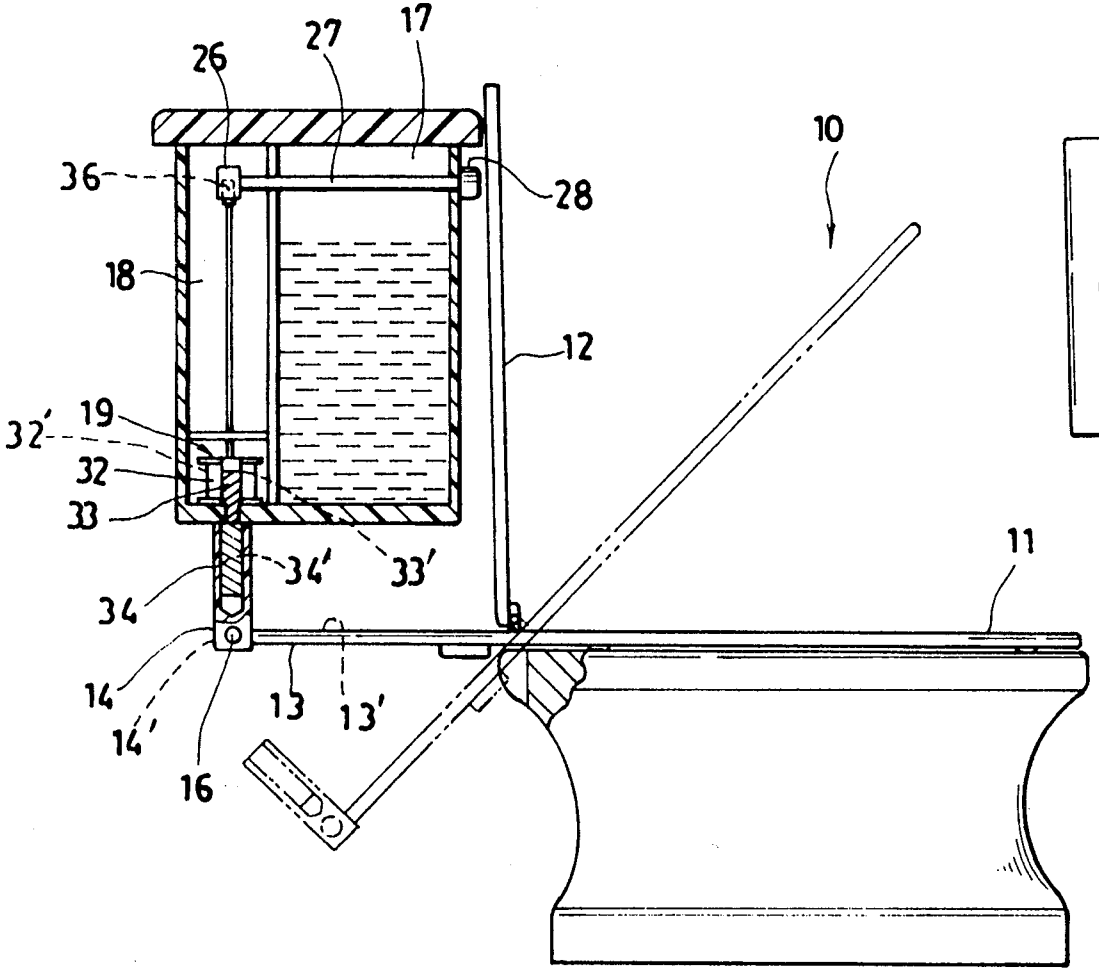
FIG. 1 is a vertical cross-sectional side view of the double-leg magnetic lever type automatic toilet seat ring raising structure according to the present invention.

Please refer to FIGS. 1 and 2 for vertical cross-sectional side view and top view of the double-leg magnetic lever type automatic toilet seat ring raising structure according to the present invention. The seat of a toilet tank 10 includes a seat ring 11 and a cover 12, under which is a pair of seat ring actuating legs 13 and is extended thereof. The end of each actuating leg 13 or 13' has a weight matching device 14 or 14' having a magnetic rod 34 or 34' and a specific gravity adjustment hole 16 installed and constructed therein. Behind the water tank 17 of the toilet tank 10 is a magnetic base holding slot 18, having an electromagnetic device 19 provided in a bottom of the holding slot 18. An iron core 33 is installed in the electromagnetic device 19 to be axially aligned with the magnetic rod 34 or 34'. As a consequence, the seat ring 11 is held down in place despite the weight of the weight matching device 14.

Figure 3:
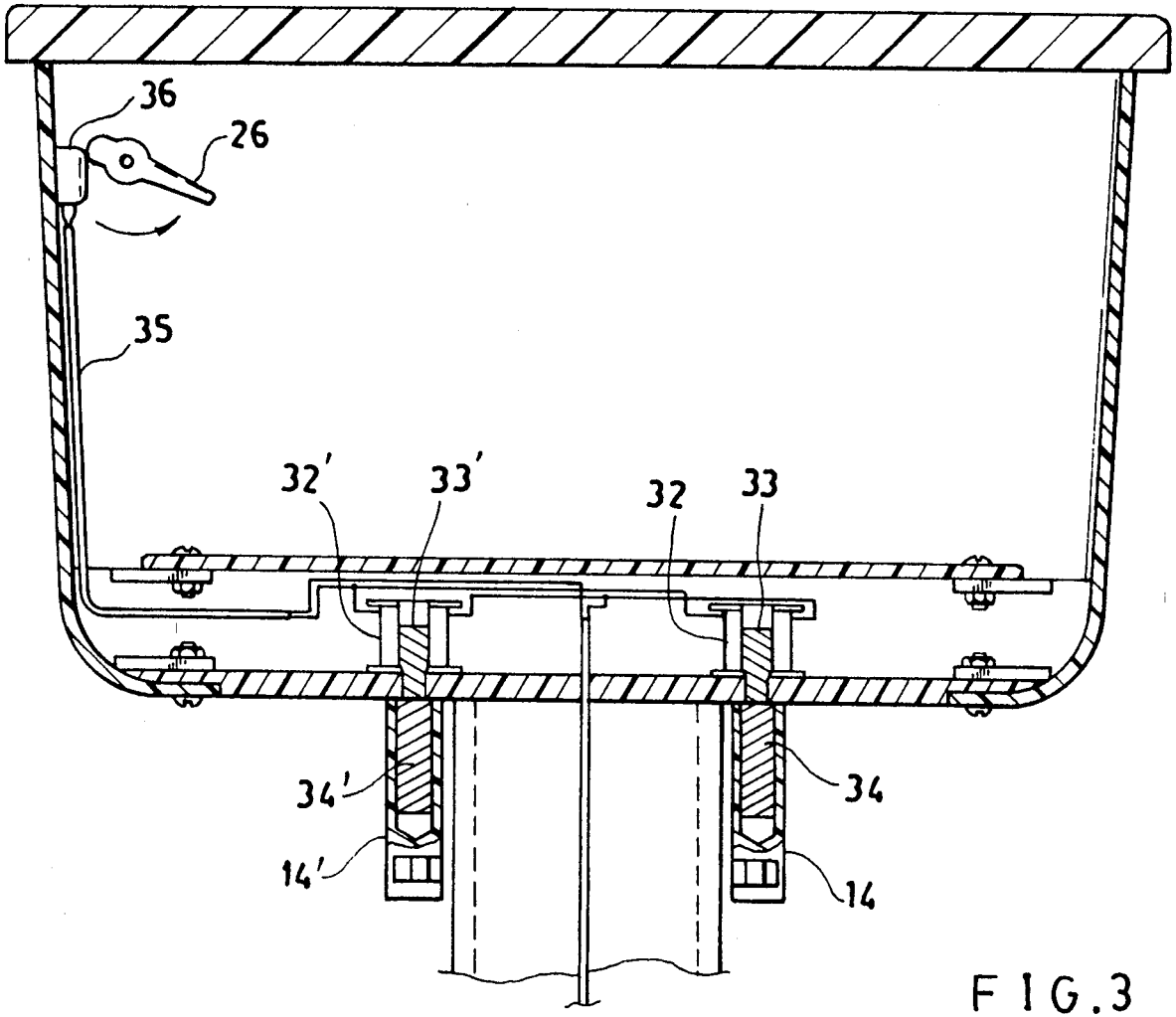
FIG. 3 is a cross-sectional view looking from the back of the structure of FIG. 1. This view shows the embodiment before the seat ring is lifted up from the structure using the disengagement of the electromagnetic force.
Figure 4:
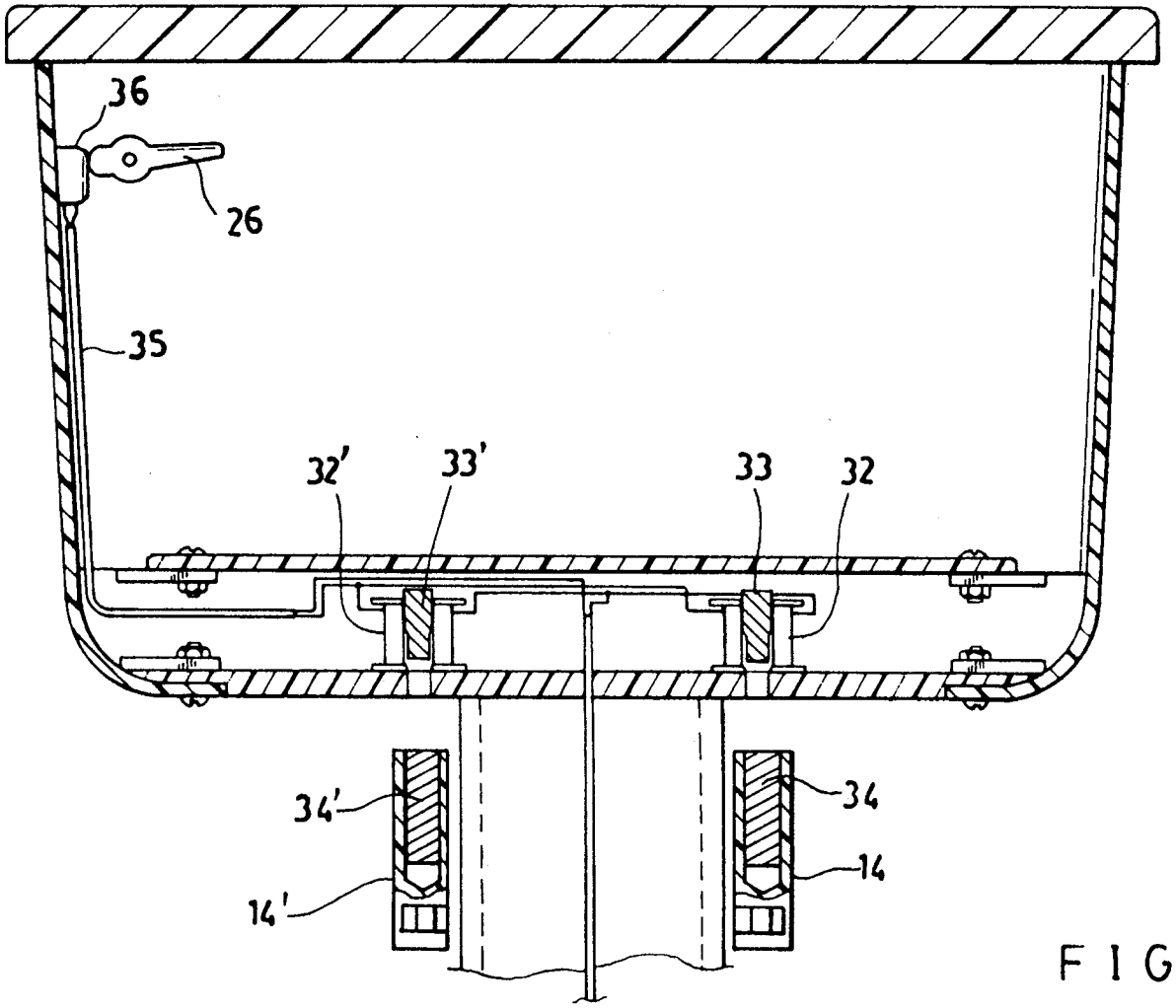
FIG. 4 is a cross-sectional view looking from the back of the structure of FIG. 1. This view shows the embodiment of the operation after the seat ring is lifted up by the structure using the disengagement of the electromagnetic force.

Referring to FIGS. 3 and 4, the weight matching devices 14 and 14' have magnetic rods 34 and 34' contained therein. The electromagnetic device 19 has electromagnetic coils 32 and 32' which attract the iron cores 33 and 33' so that the weight matching devices 14 and 14' can be magnetically engagable and releasable with the iron cores 33 and 33'. The two electromagnetic coils 32 and 32' are connected to a micro switch 36 through a wire 35. Referring to FIG. 4 when the actuating handle 28 is pushed down, the actuating switch handle 26 moves up to trigger the micro switch 36, thus the two electromagnetic coils 32 and 32' generate a magnetic field in which the magnetic force pulls the iron core 33 and 33′ upward to a balanced position. At this time the iron cores 33 and 33′ are disengaged from the magnetic rods 34 and 34′, the weight matching devices 14 and 14′ therefore drop down, permitting the toilet seat ring 11 to lift up, as shown in FIG. 1.

Figure 5:
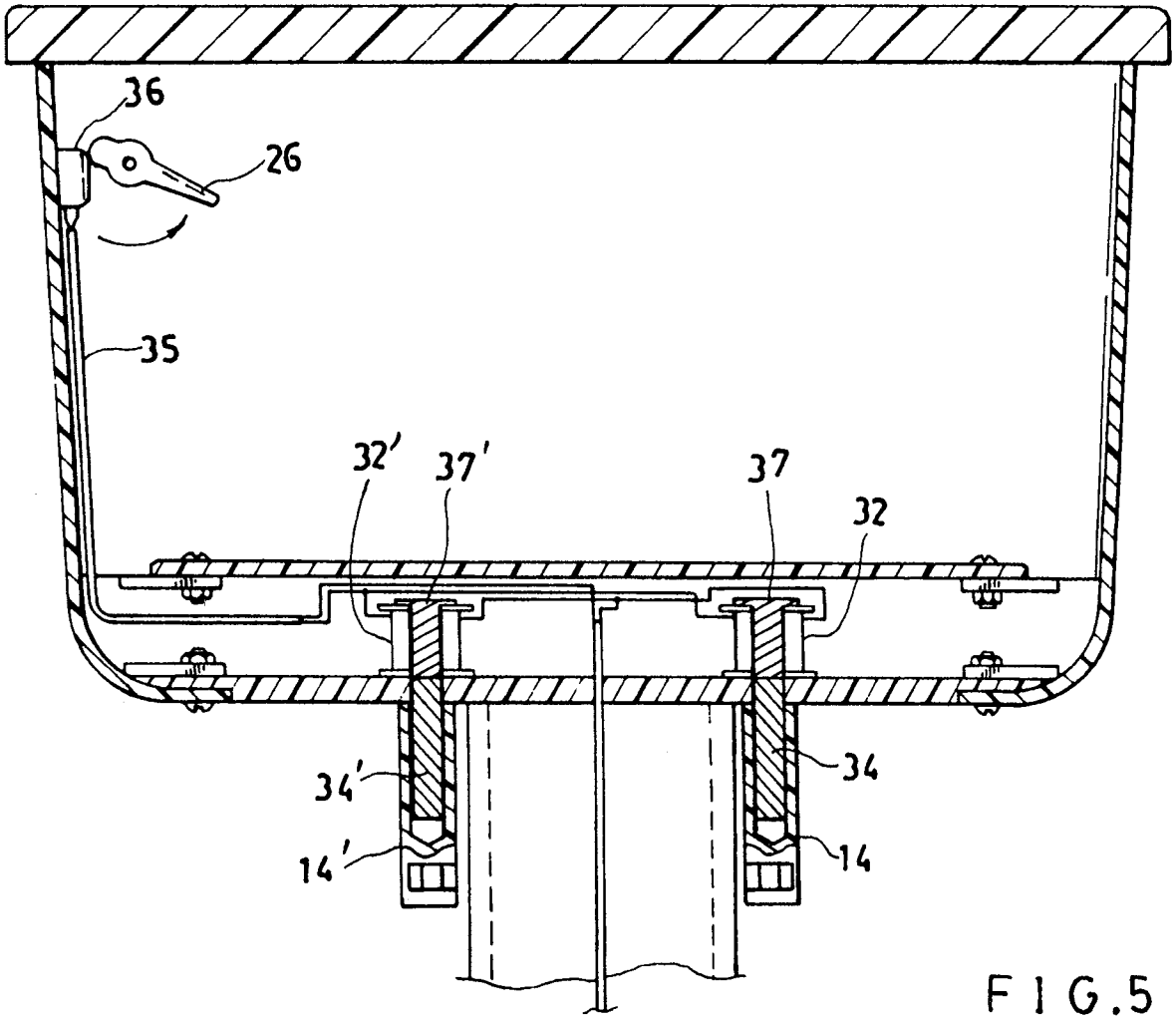
FIG. 5 is a cross-sectional view looking from the back of the structure of FIG. 1. This view shows the embodiment before the seat ring is lifted up from the structure using the repelling of the electromagnetic force.
Figure 6:
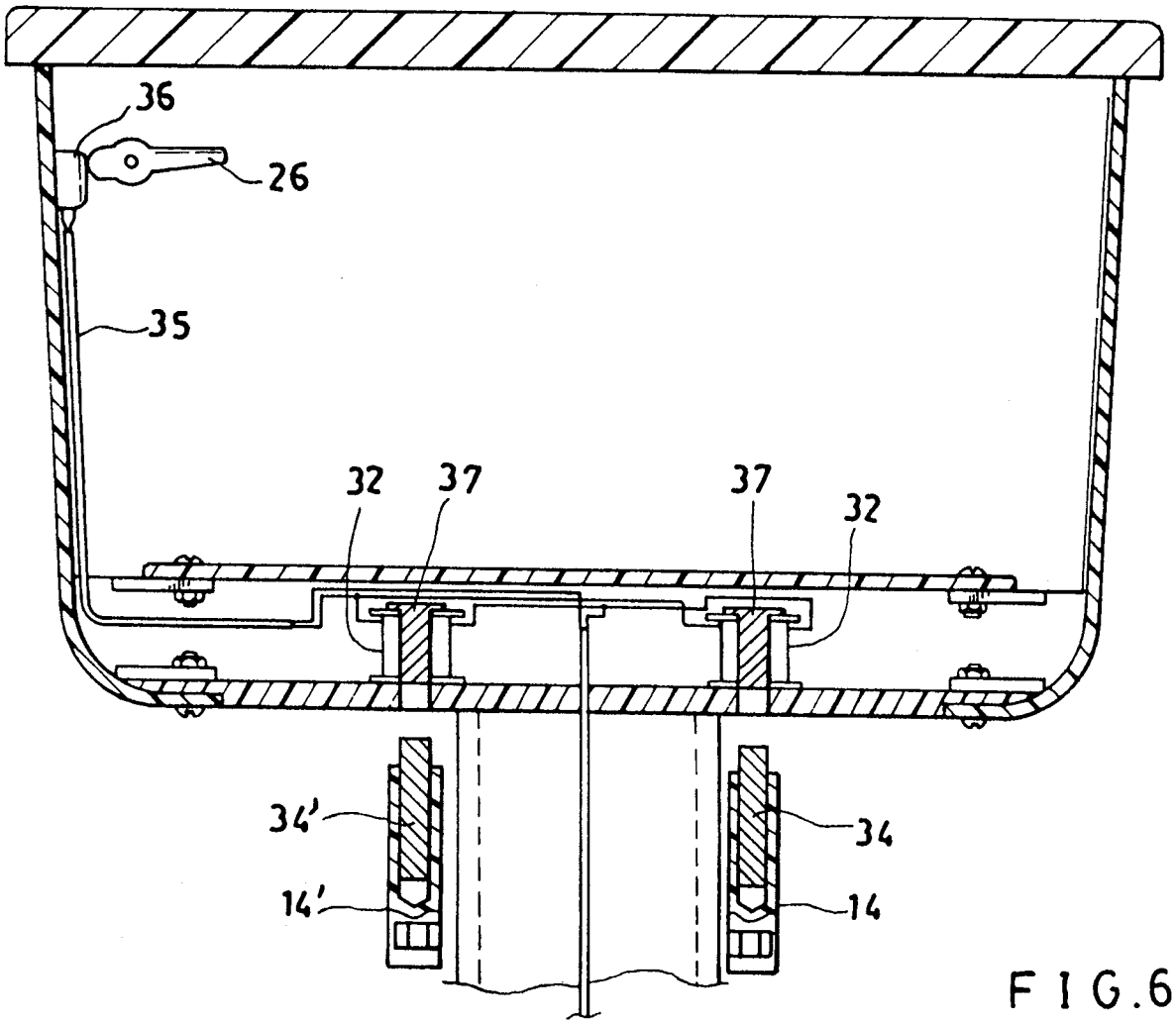
FIG. 6 is a cross-sectional view looking from the back of the structure of FIG. 1. This view shows the embodiment of the operation after the seat ring is lifted up by the structure using the repelling of the electromagnetic force.

Please refer to FIGS. 5 and 6 which shows a cross-sectional view looking from the back of the structure of FIG. 1. This view shows the embodiment of the structure using the repelling of the electromagnetic force. In a similar manner, the weight matching devices 14 and 14′ of the electromagnetic device have magnetic rods 34 and 34′ contained therein. The center of the two electromagnetic coils 32 and 32′ have iron cores 37 and 37′, each core 37, 37′ having a circular flange formed thereon to have a longitudinal section of T shape. The circular T-shaped perimeters of the iron cores 37 and 37′ permit them to be fixedly retained in the top center of the electromagnetic coils 32 and 32′. When the actuating handle 28 is pushed down, the actuating switch handle moves upward and triggers the micro switch 36. Through the conduction of the wire 35, the two magnetic coils 32 and 32′ generate a magnetic field. The iron cores 37 and 37′ have been placed at the center of the magnetic coils 32 and 32′ and are considered to be in a balanced state at this time. When electric current is applied to the electromagnetic coils 32 and 32′, they generate magnetic fields to magnetize the iron cores 37 and 37′. As a consequence, the iron cores 37 and 37′ downwardly produce a repulsive force that repels the magnetic rod 34 and 34′, causing the iron cores 37 and 37′ to be disengaged from the magnetic rods 34 and 34′ again. Thus the weight matching devices 14 and 14′ drop down and the toilet seat ring 11 moves up, as is shown in FIG. 1. Also, the micro switch 36 used can be replaced by a regular push button switch and be installed in an appropriate and convenient location on the wall.

Figure 7:
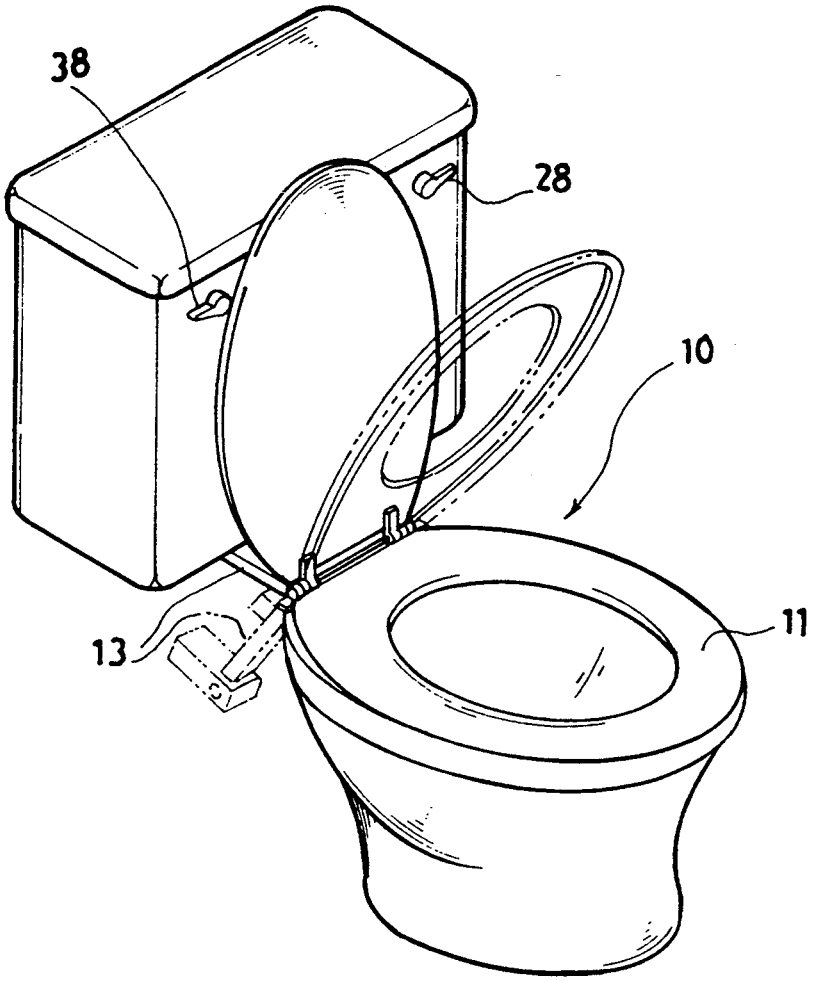
FIG. 7 is a perspective diagrammatic view of the automatic seat ring lifting structure according to the present invention.

Please refer to FIG. 7 for a perspective diagrammatic view of the double-leg magnetic lever type automatic seat ring raising device according to the present invention. When the actuating handle 28 is pushed down, the actuating legs 13 extending from the seat ring 11 drop down slowly due to the weight of the weight matching device. Accordingly, the toilet seat ring 11 is raised upward. When a user wants to lower the seat ring 11 for use, he pushes the seat ring downward gently. The attraction of the magnets can secure the seat ring 11 in place. The function of the weight matching device is to prevent the seat ring from hitting the bowl of the toilet tank rapidly thereby causing no damage thereof.

For practical usage, the actuating handle 28 can be combined with the flush handle 38 of the toilet tank so that there is only one handle to operate the toilet tank. After using the toilet tank, the user can flush the bowl and raise up the seat ring with a single step.

Having described my invention as related to the embodiment shown in the accompanying drawings, it is my intention that the invention be not limited by any of the details of description, unless otherwise specified, but rather be constructed broadly within its spirit and scope as set out in the appended claims.

What is claimed is:

1. A toilet seat ring automatic raising apparatus for use with a toilet having a bowl and a toilet water tank for supplying flushing water to said bowl, said apparatus using electromagnets comprising:

a seat ring having a pair of actuating legs extending rearwardly from said seat ring, each said actuating leg having a weight matching device secured on a rear end of said leg, two said weight matching devices operable to counterbalance a weight of the seat ring for rotating the seat ring from a horizontal use position to a lifted non-use position, each said weight matching device having a magnetic rod fixed therein and adapted to be positioned adjacent to a bottom of said toilet water tank when said seat ring is in said horizontal use position; a magnetic base holding slot adapted to be located in a rear portion of the water tank; an electromagnetic device secured in a bottom of said holding slot, said electromagnetic device including two electromagnetic coils and two iron cores each said iron core slidably held in each said electromagnetic coil and corresponding in alignment to and magnetically attractable to each said magnetic rod in said weight matching device of each said actuating leg when said seat ring is in a horizontal position, said electromagnetic coils electrically connected to a micro switch which is adapted to be triggered by an actuating handle pivotally mounted on said water tank, whereby upon triggering of said micro switch to power said electromagnetic coils, said coils electromagnetically attract each said iron core upwardly to disengage said coils from each said magnetic rod in said weight matching device, and whereby each said actuating leg is thus downwardly biased due to said weight matching device to lift said seat ring automatically to said non-use position.

2. A toilet seat ring automatic raising apparatus for use with a toilet having a bowl and a toilet water tank for supplying flushing water to said bowl, said apparatus using electromagnets and comprising:

a seat ring having a pair of actuating legs extending rearwardly from said seat ring, each said actuating leg having a weight matching device secured on a rear end of said leg, two said weight matching devices operable to counterbalance a weight of said seat ring for rotating the seat ring from a horizontal use position a lifted non-use position, each said weight matching device having a magnetic rod fixed therein and adapted to be positioned adjacent to a bottom of said toilet water tank in said use position; a magnetic base holding slot adapted to be located in a rear portion of the water tank; an electromagnetic device secured in a bottom of said holding slot, said electromagnetic device electrically connected to a micro switch which is adapted to be triggered by an actuating handle pivotally mounted on the water tank and including two electromagnetic coils and two iron cores, each said iron core having a longitudinal section of T shape and fixedly retained in a respective one of said electromagnetic coils such that each iron core corresponds with alignment to and is magnetically attractable to a respective one of said magnetic rods in said weight matching devices when said seat ring is in said horizontal use position, each said electromagnetic coil operatively energizing each said iron core upon triggering of said micro switch for producing a magnetic repulsive force acting upon each said magnetic rod in said weight matching device for repelling said weight matching device downwardly for downwardly biasing the actuating legs for lifting and seat ring automatically to said non-use position.

* * * * *